United States Patent [19]

Kimble

[11] 4,119,008

[45] Oct. 10, 1978

[54] MEANS FOR IMPROVING THE REPETITION CHARACTERISTICS OF AN UPRIGHT PIANO ACTION

[75] Inventor: Thomas E. Kimble, Covington, Ky.

[73] Assignee: D. H. Baldwin Company, Cincinnati, Ohio

[21] Appl. No.: 766,881

[22] Filed: Feb. 9, 1977

[51] Int. Cl.[2] ..... G10C 3/18

[52] U.S. Cl. ..... 84/242

[58] Field of Search ..... 84/240–243, 84/249, 253

[56] References Cited

U.S. PATENT DOCUMENTS

| | | | |
|---|---|---|---|
| 237,114 | 2/1881 | Letton | 84/241 |
| 371,578 | 10/1887 | Harcourt | 84/243 |
| 994,700 | 6/1911 | Doyle | 84/243 X |
| 1,056,375 | 3/1913 | Soper | 84/241 |

*Primary Examiner*—John Gonzales

*Attorney, Agent, or Firm*—Melville, Strasser, Foster & Hoffman

[57] ABSTRACT

Means for improving the repetition characteristics of an upright piano action of the type having a hammer for each key, the butt of the hammer being pivotally mounted on a main action rail so that the hammer can be projected from an at-rest position toward a string striking position, a wippen pivotally attached to the main action rail and operatively connected to the key, a jack pivotally connected to the wippen for transmitting the action of the key and wippen to the hammer via the hammer butt to cause the hammer to strike the string when the key is forcibly depressed and a back check serving as an oscillation damper for the hammer. The means for improving the repetition characteristics comprises an adjustable spring and linkage assembly attached at its ends to positions of substantially equal operating displacement on the wippen and the hammer butt. The spring and linkage assembly is adjusted such that, when the hammer is at its at-rest position and during movement of the hammer, wippen and jack to the point of escapement of the jack from beneath the hammer butt, the spring and linkage assembly is substantially unloaded. After escapement of the jack from beneath the hammer butt, relative movement of the wippen and hammer butt loads the spring and linkage assembly to render it capable of supporting the weight of the hammer, so that if the key is partially released and the hammer comes out of check the spring and linkage assembly will support the hammer in an intermediate position permitting the jack to return to its operating position beneath the hammer butt without full release of the key.

7 Claims, 5 Drawing Figures

MEANS FOR IMPROVING THE REPETITION CHARACTERISTICS OF AN UPRIGHT PIANO ACTION

BACKGROUND OF THE INVENTION

1. Field of the Invention

The invention relates to means for improving the repetition characteristics of a piano action, and more particularly to repetition enhancing means applicable to the action of an upright piano.

2. Description of the Prior Art

In its simplest and most usual form, the action of a vertical or upright piano is such that each key must be fully released before it can again actuate the hammer with which it is associated. There are a number of instances (as in the case of trilling or during fast single note passages) when it is desirable for a key to actuate its hammer in rapid succession without full key release between hammer actuations.

Prior art workers have devised numerous types of repetition enhancing means. For example, U.S. Pat. No. 371,578 teaches the addition to an upright piano action of a wire spring attached to the jack with a free end engaged in a bushed opening in the hammer butt. The problem with such a repetition enhancing means lies in the fact that each such spring must be adjusted to accommodate for the weight of the particular hammer with which it is associated. This can only be accomplished by bending the spring which is a difficult and imprecise adjustment method. U.S. Pat. No. 201,852 teaches the use of an elongated element or repeater extending between the wippen and the hammer butt. U.S. Pat. No. 994,700 describes a flat metal spring extending between the wippen and the hammer butt, adapted to engage and support the hammer after it rebounds from striking the string.

Other means have been developed which are not directly connected between the wippen and the hammer butt. Such means are taught in U.S. Pat. Nos. 326,576; 530,188; 543,799; 769,907; 818,473 and 1,014,201. Many of these devices are highly complex and require upright piano actions of particular design.

The present invention provides a repetition enhancing means which is simple in construction and easy to install. The repetition enhancing means may be applied to a conventional upright piano action without necessitating major modification of the action. The structure of the present invention is fully and easily adjustable to compensate for variations in hammer weight, and the like.

SUMMARY OF THE INVENTION

The most usual form of upright piano action comprises a main action rail extending parallel to the key board and pivotally supporting the butt ends of the hammers. A wippen for each hammer is pivotally attached to the main action rail and is operatively connected to one of the piano keys. Each wippen has a jack pivoted thereto. The free end of the jack engages beneath the hammer butt and transmits the action of the key and wippen to the hammer butt to move the hammer from its at-rest position toward its string-striking position. During this action of the hammer, the free end of the jack escapes from under the hammer butt. Upon full release of the key, the jack is free to return to its operating position beneath the hammer butt.

The repetition enhancing means of the present invention comprises a spring and linkage assembly, the ends of which are attached to the wippen and the hammer butt at positions of substantially equal operating displacement. The spring and linkage assembly comprises a ball-head adjustment screw threadedly and adjustably engaged in the wippen. An elongated rod-like link is pivotally attached at its upper end to the hammer butt. At its lower end, the link is provided with a hollow, cylindrical guide sleeve containing a compression spring and adapted to receive the ball-head of the adjustment screw with a snap fit.

The ball-head screw is turned in the wippen until the spring is essentially unloaded when the hammer is in its at-rest position and during the course of travel of the wippen, jack and hammer up to the point where the jack escapes from beneath the hammer butt. After escapement of the jack, the relative motion between the wippen and hammer butt is such as to load the spring so that it is capable of supporting the weight of the hammer. When the key is partially released to the extent that the hammer comes out of check (as will be described hereinafter), the spring and link assembly will support the hammer in an intermediate position allowing the jack to return to its operating position beneath the hammer butt without requiring full key release. In this manner, the key may be repeatedly actuated without full key release therebetween and each actuation of the key will cause the hammer to strike the string.

DESCRIPTION OF THE PREFERRED EMBODIMENTS

Figure 1:
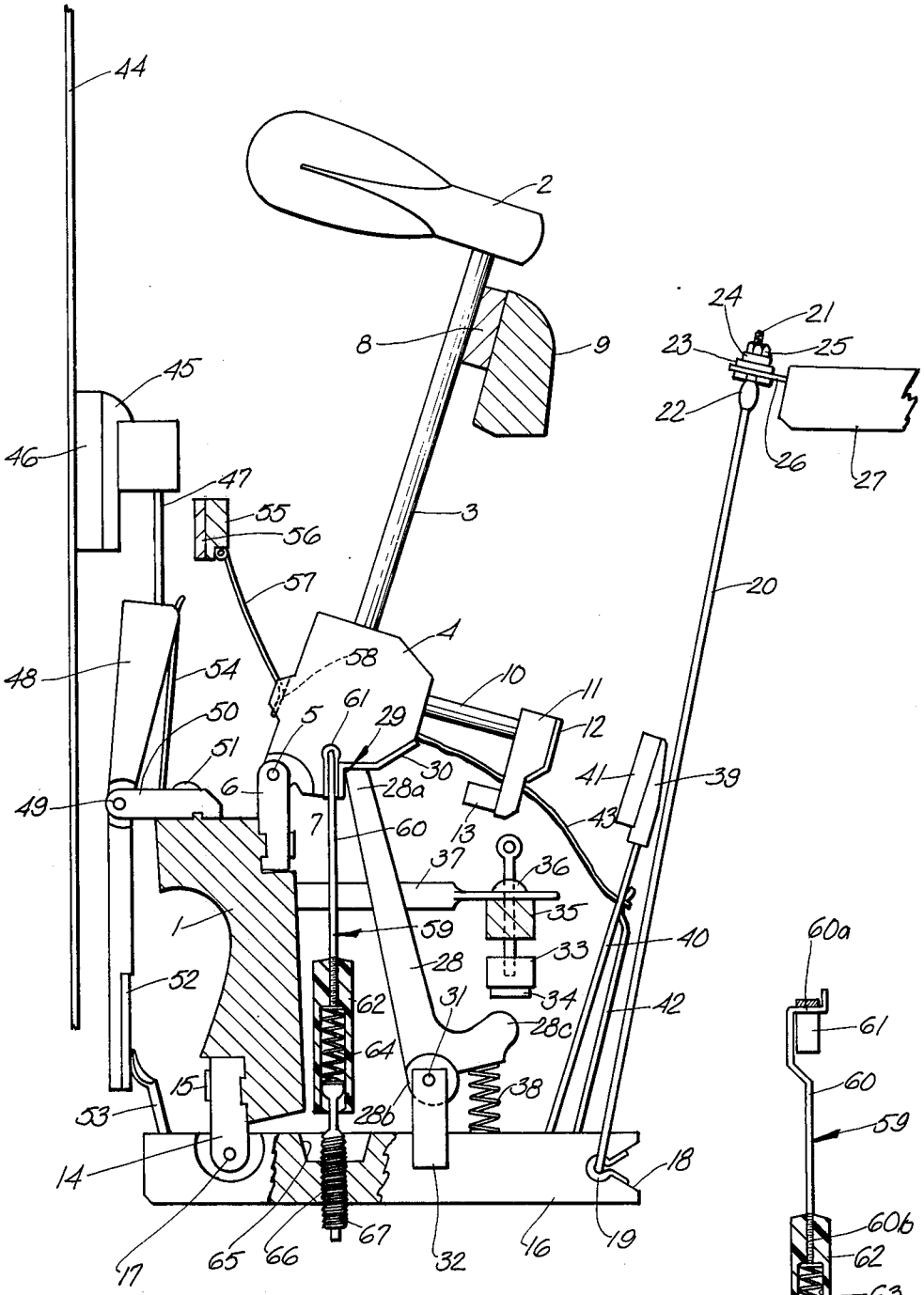
FIG. 1 is a fragmentary elevational view, partly in cross section, illustrating an upright piano action incorporating the repetition enhancing means of the present invention and illustrating the parts in their respective positions when the key is fully released.

FIG. 1 is an elevational view of a conventional upright or vertical piano action with the various parts in their normal, at-rest positions (i.e. with the key fully released). A main action rail is shown at 1. It will be understood by one skilled in the art that the main action rail extends within the piano case (not shown) parallel to the key board. A hammer 2 is connected by a shank 3 to a hammer butt 4. The hammer butt 4 is attached by pivot pin 5 to a bifurcated member 6 attached to the main action rail 1 by a screw 7. In its at-rest position, the shank 3 of hammer 2 rests against a pad 8 of felt or other appropriate material supported by a hammer rest rail 9 which extends parallel to the main action rail 1. The hammer butt 4 also supports a back stop shank 10 terminating in a back stop 11, the purpose of which will be described hereinafter. The back stop 11 is provided with a layer 12 of felt, leather or other appropriate and well known material providing a frictional surface. The back stop has a second piece 13 of felt or the like intended to prevent abutment of the back stop by the jack to be described hereinafter. A second bifurcated member 14 is mounted on the main action rail 1 by any appropriate means such as a screw 15. A wippen 16 is pivotally mounted between the bifurcations of member 14 by pivot pin 17. The free end of the wippen 16 is provided with a notch 18 adapted to accommodate a bushing 19 of cloth, felt or the like receiving the lowermost end of the drop action connecting rod 20.

The uppermost end of the connecting rod 20 is threaded as at 21 and provided with a flat or enlargement 22. A resilient bushing 23 and a washer-like element 24 of cloth, felt or other appropriate material is adjustably mounted and maintained on the upper end of connecting rod 20 by a nut 25. The resilient bushing 23 is engaged by a yoke 26 mounted on the rearward end of piano key 27.

A jack is shown at 28. The uppermost end **28*a* of the jack is adapted to engage the underside of hammer butt 4 as at 29. For this purpose, the underside of hammer butt 4 may be provided with a layer 30 of cushioning material such as felt, cloth or the like. At its lower end, the jack is provided with a heel portion 28*b* attached by pivot pin 31 to a bifurcated jack support 32. The jack support 32, in turn, is mounted upon wippen 16**.

The jack 28 also has a toe portion **28*c* adapted to cooperate with a jack stop 33 provided with an appropriate cushion 34 of felt, cloth or the like. The jack stop is adjustably mounted on a jack stop rail 35 which extends parallel to hammer rest rail 9 and main action rail 1. The jack stop rail 35 is mounted by a plurality of screws (one of which is shown at 36) to a plurality of supports (one of which is shown at 37) which, in turn, are attached to the main action rail 1. There is a compression spring 38 located between the wippen 16 and the toe portion 28*c* of jack 28. The compression spring 38 urges the jack to its operating position beneath hammer butt 4, as is illustrated in FIG. 1**.

The wippen 16 also supports a back check 39 attached to the wippen by means of an elongated shank 40. The back check 39 has a cushion 41 of felt, fabric or other appropriate material adapted to cooperate with the layer 12 of back stop 11, as will be described hereinafter. The wippen 16 also supports an elongated hook-like element 42 to which one end of a conventional bridle tape 43 is attached. The bridle tape 43 passes through a perforation in back stop 11 and is affixed at its other end to hammer butt 4. Bridle tape 43 serves as a control for the hammer and also holds the action parts in place when the entire action assembly is removed during piano servicing, as is well known in the art.

A string is illustrated at 44. The string 44 is normally engaged by a damper 45 having for this purpose a layer 46 of felt, cloth or other appropriate yielding material. Damper 45 is connected by a shank 47 to a damper lever 48. Substantially intermediate its ends, the damper lever 48 is attached by pivot pin 49 to a bifurcated member 50. The bifurcated member 50 is affixed to the main action rail 1 by any appropriate means such as a screw 51. The lowermost end of the damper lever 48 is provided with a layer of felt, cloth or other appropriate cushion material 52 which is engaged by an arm or "spoon" 53 mounted on wippen 16. The damper assembly is normally urged to its spring engaging position as shown in FIG. 1 by spring 54. One end of spring 54 is attached to bifurcated element 50. The free end of spring 54 engages the uppermost end of damper lever 48, as illustrated.

As will be evident hereinafter, when the key 27 is depressed and before the string 44 is struck by hammer 2, damper 45 will be shifted to a retracted position away from string 44 by the cooperation of damper lever 48 and the spoon 53 mounted on wippen 16. The retracted position of damper 45 is determined by a damper rail 55 supported by means not shown and extending parallel to main action rail 1 and hammer rest rail 9. The damper rail 55 is provided with a cushioning layer 56 of felt, cloth or other appropriate yielding material, serving as an overtravel stop for damper shank 47.

Damper rail 55 serves an additional purpose in that it supports one end of spring 57. The free end of spring 57 abuts hammer butt 4 as at 58. The spring 57 is intended to hold the hammer shank 3 against the yielding material 8 of hammer rest rail 9 when the hammer is in its normal, unactuated condition.

The elements thus far described constitute a typical, conventional action for an upright or vertical piano. The action as thus far described would require full key release between actuations of key 27 in order for the key 27 to operate the hammer 2. In accordance with the teachings of the present invention, the action thus far described is provided with an adjustable spring and linkage assembly generally indicated at 59.

Figure 2:
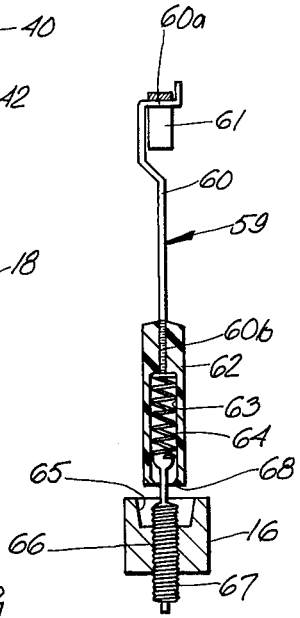
FIG. 2 is an elevational view, partly in cross section illustrating the spring and linkage assembly of the present invention.

Reference is now made to FIGS. 1 and 2 wherein like parts have been given like index numerals. The spring and linkage assembly 59 comprises a rod or wire-like element 60, the upper end **60*a* of which is formed into a hook-like configuration as is most clearly shown in FIG. 2. The end 60*a* is adapted to be rotatively received in a bushing 61 of felt, fabric or the like mounted in hammer butt 4. The lower end 60*b* is threadedly engaged in the upper end of a guide sleeve 62. While the guide sleeve 62 may be made of any appropriate material such as metal or the like, it lends itself well to being molded of a resilient plastic. The guide sleeve 62 has an axial bore 63 open at its lower end. The bore 63 accommodates a compression spring 64**.

The wippen 16 has a depression 65 in its upper surface. A threaded bore 66 extends from depression 65 through the bottom surface of the wippen. A ball head adjustment screw 67 is threadedly engaged in bore 66. The ball head of screw 67 is located within the bore 63 of guide sleeve 62. One end of compression spring 64 abuts the uppermost end of bore 63. The other end of the compression spring abuts the ball head of screw 67. The lowermost end of the guide sleeve is provided with an internal flange 68, sufficiently restricting the open lower end of bore 63 so that the ball head of screw 67 will enter the bore with a snap fit. Depression 65 in the upper surface of wippen 16 will accommodate the lowermost end of guide sleeve 62 if the spring and linkage assembly 59 is so adjusted as to require it.

The operation of the piano action provided with the adjustable spring and linkage assembly may be described as follows. As indicatedabove, FIG. 1 illustrates the action and the adjustable spring and linkage assembly in their normal, at-rest position assumed when key 27 is fully released. Under these circumstances, the hammer shank 3 rests against the cushion 8 of hammer rest rail 9. The jack 28 is in its normal operating position with its uppermost end 28*a* in engagement with the underside of hammer butt 4 as at 29. Damper 45 and its cushion 46 are in abutment with string 44 under the urging of spring 54 and the spring 64 of the adjustable spring and linkage assembly is in its expanded condition, spring 64 being essentially unloaded.

Figure 3:
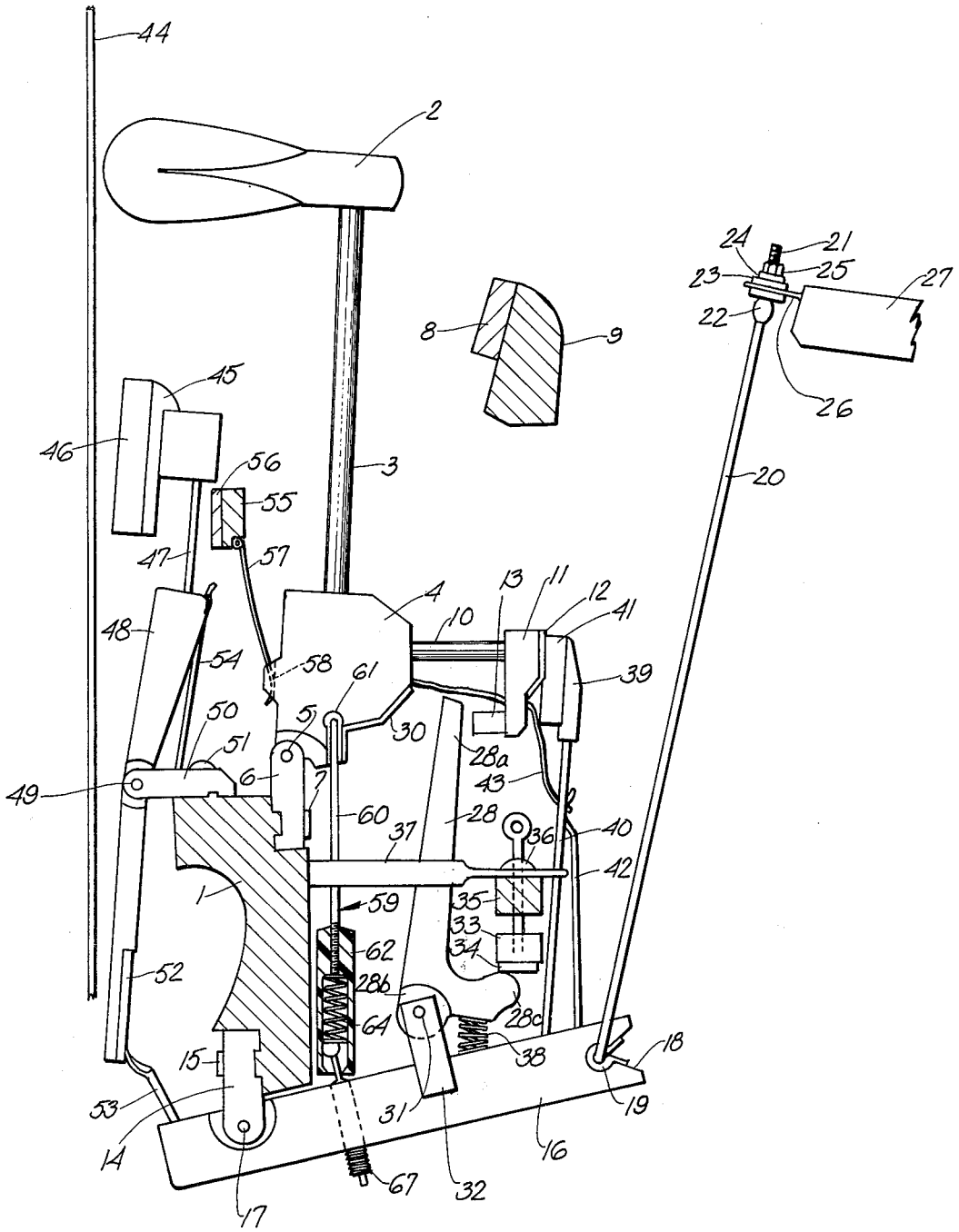
FIG. 3 is a fragmentary elevational view, partly in cross section, similar to FIG. 1 and illustrating the parts in their positions shortly after the key has been fully depressed and the hammer has rebounded to the back-check position.

FIG. 3 illustrates the location and condition of the various elements immediately after actuation of key 27 and rebound of hammer 2. Depression of key 27 will cause the rearward end of the key to pivot upwardly causing the free end of wippen 16 to pivot upwardly about pivot pin 17 under the pulling force supplied to the wippen by connecting rod 20. As the free end of wippen 16 pivots upwardly, the uppermost end 28*a* of the jack 28 will apply an upward force to hammer butt 4 causing hammer 2 to pivot toward string 44. At the same time, the toe portion 28*c* of jack 28 will be engaged by the cushion 34 of jack stop 33 causing the jack to pivot about pivot pin 31 and to escape out from under the hammer butt 4. After hammer 2 strikes string 44, it rebounds to the backcheck position where it is held by the frictional engagement of surfaces 12 and 41.

The movement of wippen 16 from the position shown in FIG. 1 to the position shown in FIG. 3 will have produced two additional simultaneous results. First of all, the arm or spoon 53 mounted on the wippen will engage the cushion 52 of the lower end of the damper lever 48, causing the damper to shift away from string 44 (against the action of spring 54) immediately prior to the striking of the string by hammer 2. In order for the hammer to properly activate the string 44, it is necessary that the hammer move away from the string immediately upon striking it. The resilience of string 44, itself, will tend to make the hammer rebound. Secondly, the movement of wippen 16 carries backcheck 39 to the position illustrated in FIG. 3 in order to allow frictional engagement of the pad 12 of hammer back stop 11 by the pad 41 of back check 39.

If key 27 were fully released, the key, the connecting rod 20 and the wippen 16 would return to their positions illustrated in FIG. 1. This would once again permit the damper pad 46 to engage the string 44. The downward shifting of the free end of wippen 16 will disengage back check 39 from back stop 11 allowing the hammer to assume its at-rest position with its shank 3 against hammer rest rail pad 8 (under the influence of spring 57). Finally, the lowering of the free end of the wippen will also disengage the toe portion 28*c* of jack 28 from the pad 34 of jack stop 33 and under the influence of spring 38, the jack will be free to assume its normal operating position illustrated in FIG. 1.

Returning to FIG. 3, it will be understood that once the uppermost end 28*a* of jack 28 escapes from the underside of hammer butt 4, the relative movement of the hammer butt and the wippen 16 will be such as to load compression spring 64 of the adjustable spring and linkage assembly 59. Depending upon the weight of the individual hammer 2, the strength of spring 57 and the freeness of the action, the ball head adjustment screw should be so adjusted that compression spring 64, in loaded condition, can support the hammer in an intermediate position as illustrated in FIG. 4.

Figure 4:
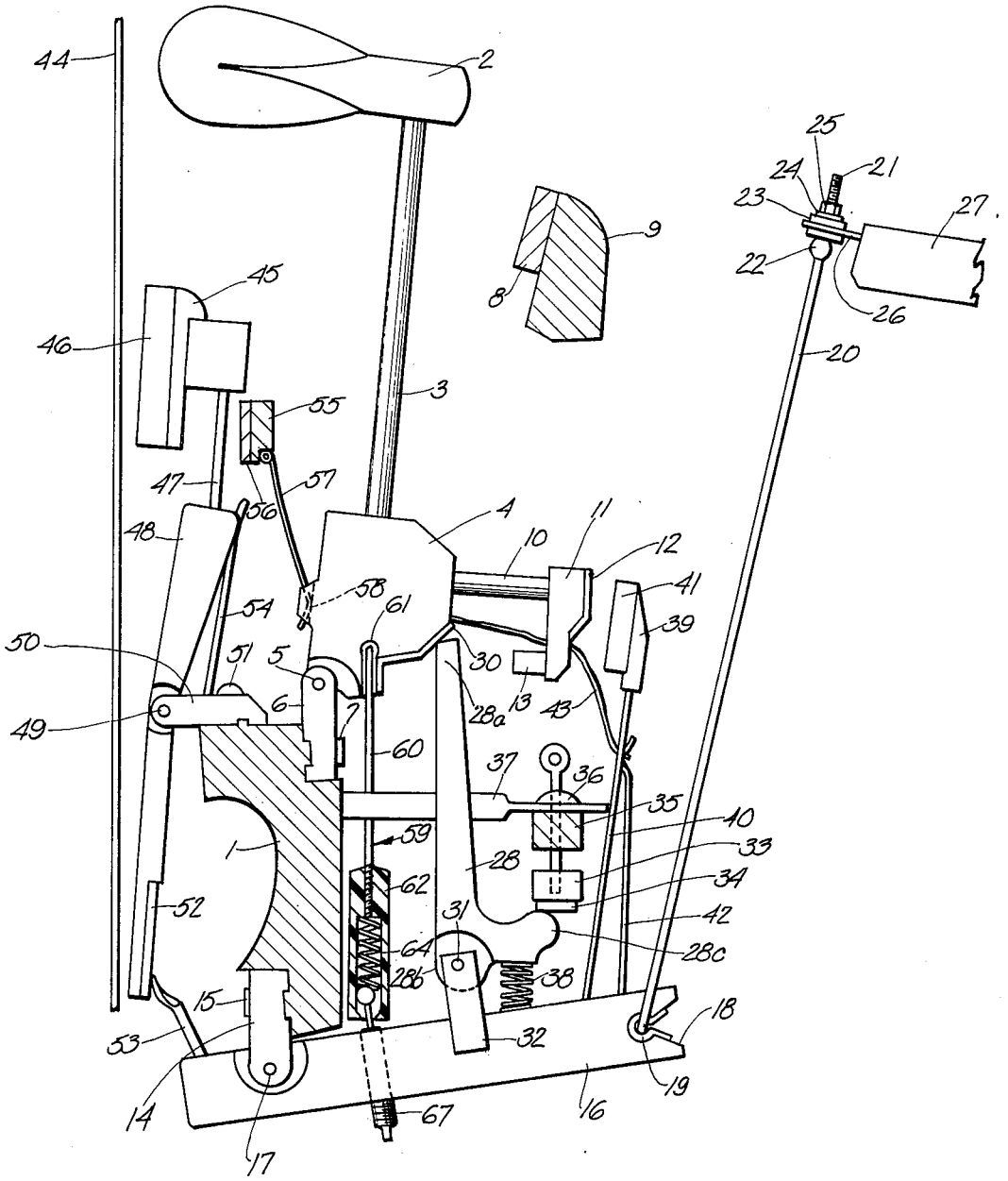
FIG. 4 is an elevational view, partly in cross section, similar to FIG. 1 and illustrating the positions of the various elements near the beginning of partial release of the key.
Figure 5:
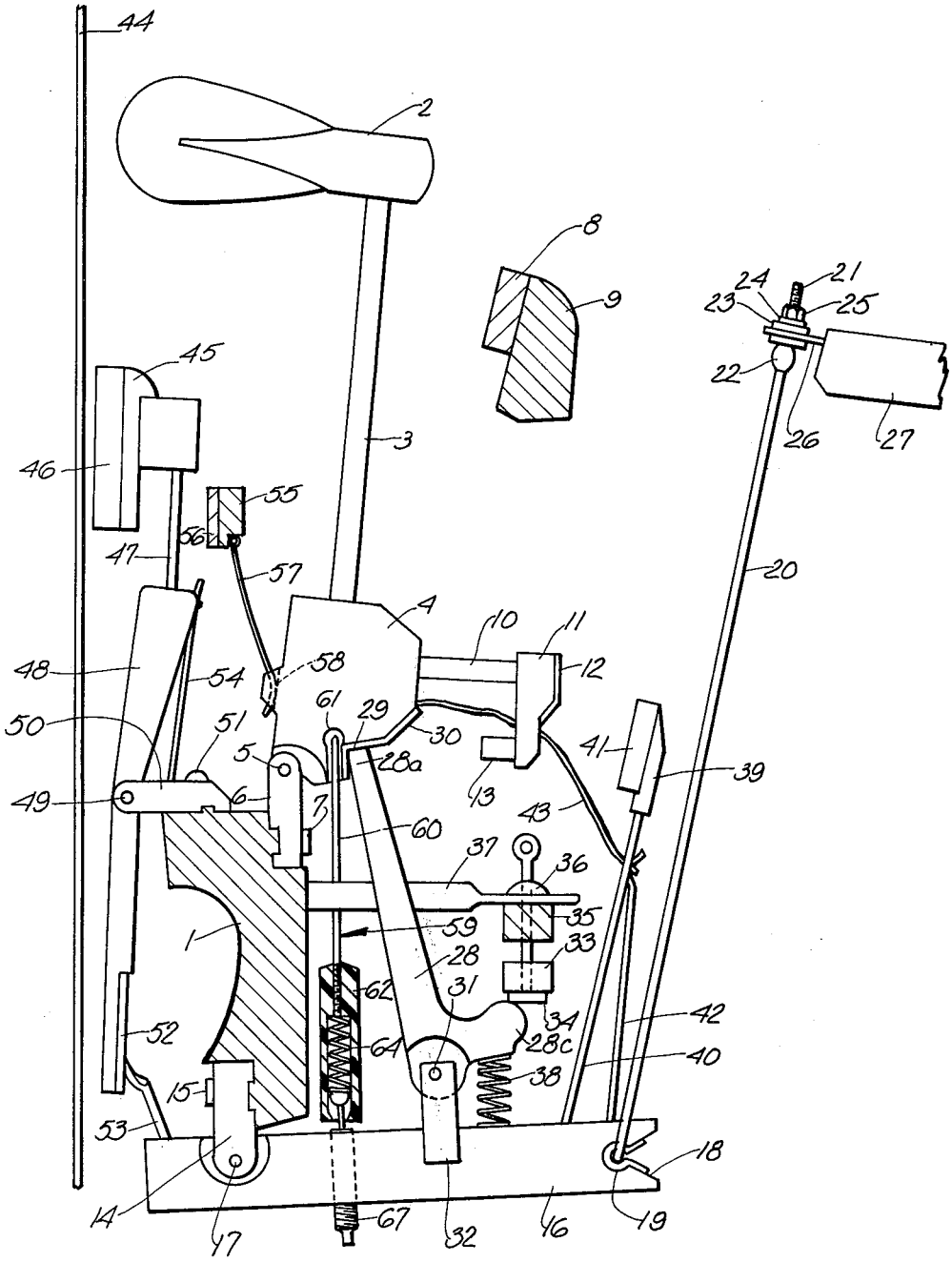
FIG. 5 is an elevational view, partly in cross section, similar to FIG. 1 and illustrating the return of the jack to its operating position beneath the hammer butt upon partial release of the key.

In FIG. 4 the key 27 has been only slightly released, allowing the hammer to come out of check (i.e., permitting the disengagement of back check 39 and back stop 11). The slight lowering of the free end of wippen 16 has caused the distance between jack stop pad 34 and the wippen to increase, allowing the jack to begin pivoting toward its operative position beneath hammer butt 4, under the influence of spring 38. As soon as key 27 is released only to the extent that the distance between wippen 16 and the pad 34 of jack stop 33 is such as to permit the jack 28 to pivot to its operating position under the influence of spring 38, the jack will do so, since the hammer is held in its intermediate position by the adjustable spring and linkage assembly 59. This condition is illustrated in FIG. 5, where again like parts have been given like index numerals. It will be evident from FIG. 5 that if key 27 is actuated from its only partially released position the hammer 2 will again strike string 44 since jack 28 had resumed its operating position. Thus, key 27 may be actuated at so rapid a rate that it is not fully released between actuations and it will nevertheless cause the hammer 2 to strike string 44 at each actuation. Under these circumstances the components of the action and the elements of the adjustable spring and linkage assembly will alternate positions between those illustrated in FIG. 3 and those illustrated in FIG. 5. Upon complete release of key 27, the parts will resume the positions shown in FIG. 1.

Modifications may be made in the invention without departing from the spirit of it.

The embodiments of the invention in which an exclusive property or privilege is claimed are defined as follows:

1. In an upright piano action of the type having a hammer for each key, each hammer having a pivotally mounted hammer butt so that the hammer is shiftable between an at-rest position and a string striking position, a pivotally mounted wippon operatively connected to the key, a jack pivotally mounted on the wippen and movable by the action of the key and wippen from an operative position beneath the hammer butt to a position out from under the hammer butt to propel the hammer from its at-rest position toward its string striking position upon depression of the key, and a back check to hold said hammer in a rebound position after striking said string and while said key is fully depressed, the improvement comprising an adjustable spring and linkage assembly attached at its ends to said wippen and said hammer butt, said spring and linkage assembly being so adjusted that said spring is essentially unloaded when said jack is beneath said hammer butt and upon depression of the key during movement of said hammer, wippen and jack to the point where said jack escapes from under said hammer butt, and so loaded by the relative movement of the wippen and the hammer butt after the jack has shifted out from under the hammer butt and said hammer has struck said string as to hold said hammer in an intermediate position upon partial release of said key and release of said hammer by said back check, permitting said jack to regain its operative position beneath said hammer butt without full key release.

2. The structure claimed in claim 1, wherein said spring and linkage assembly is attached at its ends to positions on said wippen and said hammer butt, said positions of attachment being of substantially equal operating displacement from depression of said key to said point where said jack escapes from under said hammer butt.

3. The structure claimed in claim 1 wherein said spring and linkage assembly comprises a ball head screw adjustably engaged in said wippen, a guide sleeve having upper and lower ends, said sleeve having an axial bore closed at said upper end and open at said lower end, said bore being adapted to receive the ball head of said ball head screw, a compression spring located within said bore, one end of said compression spring abutting said closed upper end of said sleeve, the other end of said compression spring abutting said ball head of said ball head screw, a wire-like link having an upper end and a lower end, said lower end of said link being fixedly attached to said upper end of said guide sleeve, said upper end of said wire-like link being pivotally attached to said hammer butt.

4. The structure claimed in claim 3, wherein said attachment of said spring and linkage assembly to said wippen and said hammer butt is at positions of substantially equal operating displacement from depression of said key to said point where said jack escapes from under said hammer butt.

5. The structure claimed in claim 3 wherein said lower end of said guide sleeve is provided with an internal flange sufficiently restricting said axial bore so that the ball head of said ball head screw will enter said bore with a snap fit.

6. The structure claimed in claim 3 wherein said upper end of said wire-like link is of a hook-like configuration adapted to be rotatively received in said hammer butt.

7. The structure claimed in claim 5 wherein said guide sleeve is cylindrical and is made of a resilient plastic material.

* * * * *